United States Patent [19]

Daigle

[11] 4,103,741

[45] Aug. 1, 1978

[54] OIL WELL PERFORATION TESTING DEVICE

[75] Inventor: Milton L. Daigle, Houma, La.

[73] Assignee: Tool Masters, Inc., Houma, La. ; a part interest

[21] Appl. No.: 802,481

[22] Filed: Jun. 1, 1977

[51] Int. Cl.[2] ..... E21B 33/124

[52] U.S. Cl. ..... 166/147; 166/152; 166/186; 166/188; 166/334

[58] Field of Search ..... 166/147, 150, 152, 188, 166/186, 183, 333, 334

[56] References Cited

U.S. PATENT DOCUMENTS

| | | | |
|---|---|---|---|
| 2,426,164 | 8/1947 | Breukelman | 166/150 |
| 2,970,649 | 2/1961 | Brown | 166/121 |
| 3,169,580 | 2/1965 | Bateman | 166/147 |
| 3,329,214 | 7/1967 | Ehlert | 166/152 |
| 3,519,075 | 7/1970 | Mullins | 166/150 |

*Primary Examiner*—James A. Leppink

*Attorney, Agent, or Firm*—Clarence A. O'Brien; Harvey B. Jacobson

[57] ABSTRACT

An elongated tubular assembly is provided defining a longitudinal central passage therethrough. Longitudinally spaced opposing packer structures are carried by and extend about the exterior of the tubing assembly and the latter includes a bypass passage extending therealong, independent of the central passage, opening at its opposite ends to the exterior of the tubular assembly on the remote sides of the packer structures. The tubular assembly further includes generally radial perforation wash fluid passages opening inwardly into the central passage at their inner ends and outwardly of the exterior of the tubular assembly intermediate the packer structures. The tubular assembly is disposed in a tubing string immediately above a full opening and full closing tubing section disposed therebelow and supporting a drag block at its lower end and the tubular assembly is disposed immediately below a selectively openable and closable fluid bypass tube section disposed thereabove.

11 Claims, 15 Drawing Figures

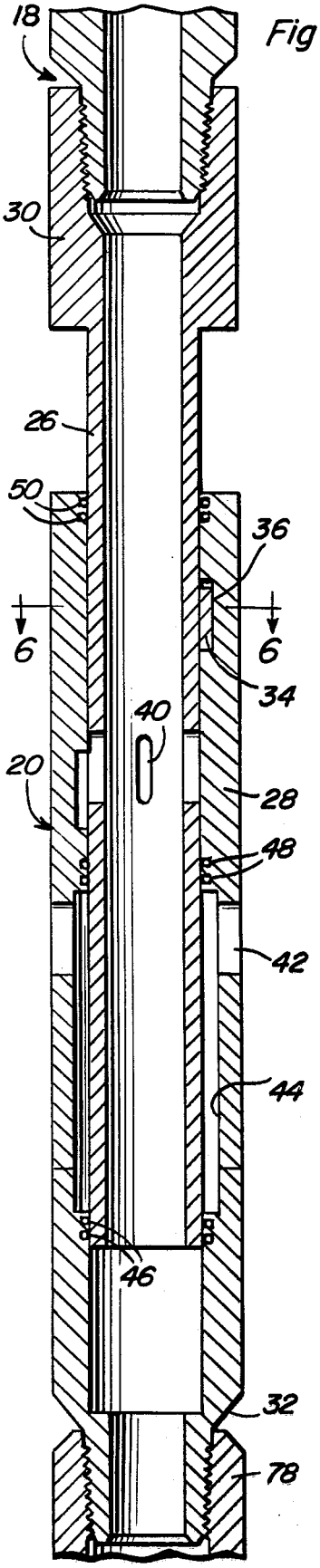
Fig. 5
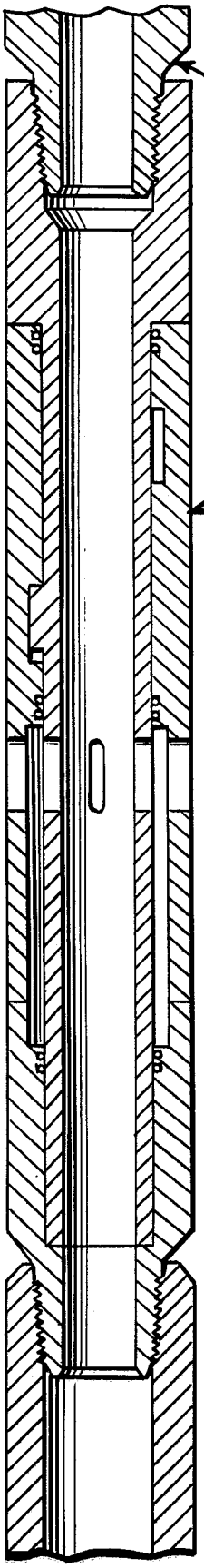
Fig. 5a
Fig. 7
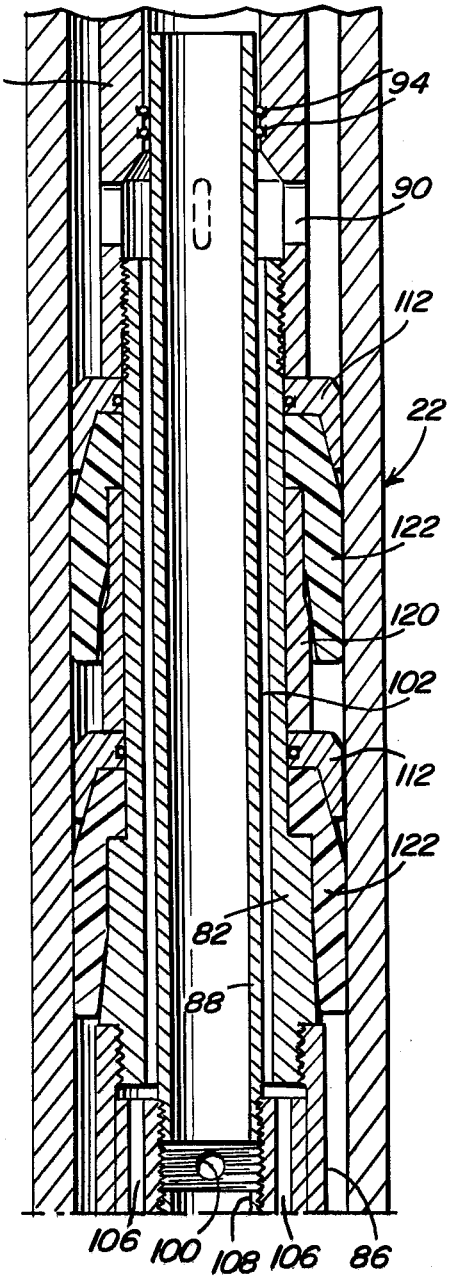

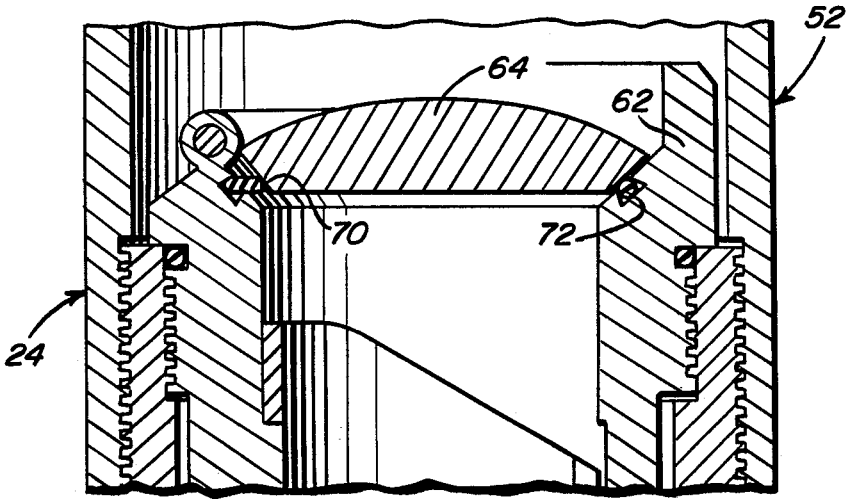
Fig. 9
Fig. 10
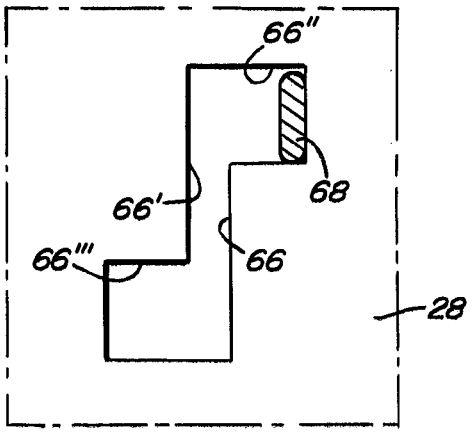
Fig. 11
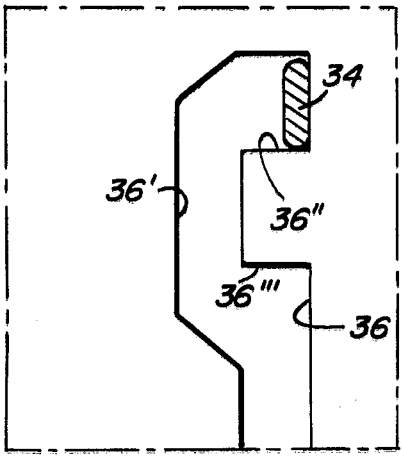

OIL WELL PERFORATION TESTING DEVICE

BACKGROUND OF THE INVENTION

There are many reasons why zone difficulty is encountered with a well and when zone difficulty is experienced it is often desired to investigate the producing zone through existing casing perforations.

Existing tools for this purpose are primarily of the type which are limited to single operations. A perforation wash tool of conventional design cannot be utilized to perform the wash operations as well as to plasticize, acidize, etc., all in one trip through the casing. In addition, conventional wash tools utilized with ball subs may not be used to re-perforate. Accordingly, if multiple operations are to be performed the tubing string must be run into and pulled out of the casing numerous times to perform a series of operations at the producing zone. Therefore, a need exists for a multi-purpose wash tool which may be utilized not only for perforation washing operations but also for plasticizing, acidizing and re-perforation operations all during the same trip of the tubing string into the well.

Examples of various other tools including some of the structural and operational features of the instant invention are disclosed in U.S. Pat. Nos. 2,568,087, 2,970,649, 3,071,960 and 3,189,096.

BRIEF DESCRIPTION OF THE INVENTION

The wash tool of the instant invention is to be utilized in conjunction with a selectively openable and closable bypass disposed closely thereabove and may be utilized in conjunction with a ball sub immediately therebelow, but is preferably utilized in conjunction with a selectively openable and closable tubing tester immediately therebelow. The tubing tester to be utilized in conjunction with the perforation wash tool is of the full open and full closing type and may be locked in the full opening and full closed positions.

The main object of this invention is to provide a wash tool for washing, plasticizing, acidizing and re-perforation of the producing zone of a well casing.

Another object of this invention is to provide a perforation wash tool including structural and operational features thereof enabling the producing zone of a well to be investigated through the existing perforations.

Still another object of this invention is to provide a perforation wash tool whose structural and operational features are enhanced by a bypass tubing section disposed closely thereabove as well as a openable and closable tubing tester section disposed closely therebelow.

Another very important object of this invention is to provide an apparatus in accordance with the preceding objects that is sufficiently compact to allow work to be performed in wells with little or no rathole.

A final object of this invention to be specifically enumerated herein is to provide a perforation wash tool in accordance with the preceding objects and which will conform to conventional forms of manufacture, be of simple construction and easy to use so as to provide a device that will be economically feasible, long-lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCIPTION OF THE DRAWINGS

FIGS. 1, 1*a* and 1*b* are top, intermediate and lower fragmentary vertical sectional views of a well casing with the upper, intermediate and lower portions of the instant invention disposed therein and illustrated in elevation;

FIG. 5 is a vertical longitudinal sectional view of the upper safety bypass portion of the instant invention with the safety bypass illustrated in the closed position;

Figure 1:
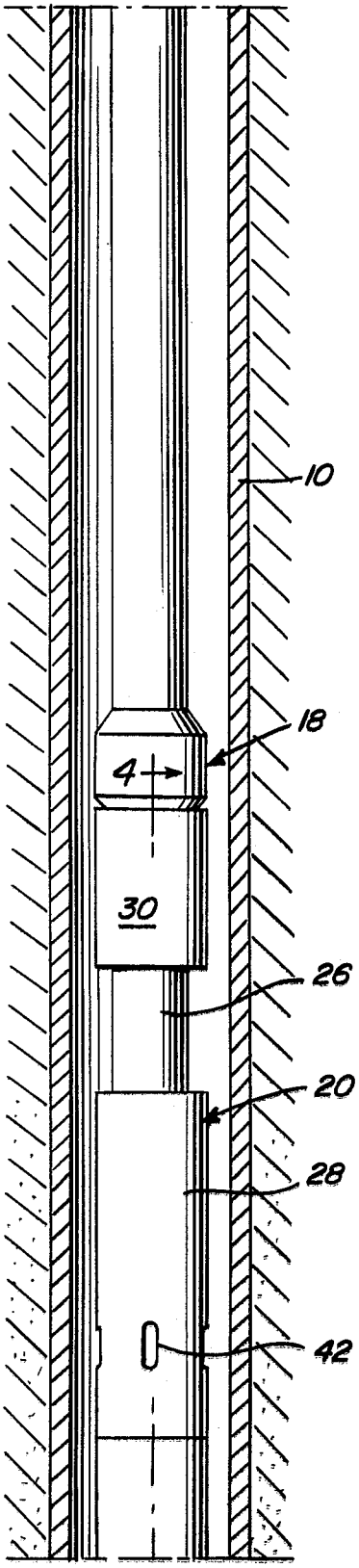
Figure 1A:
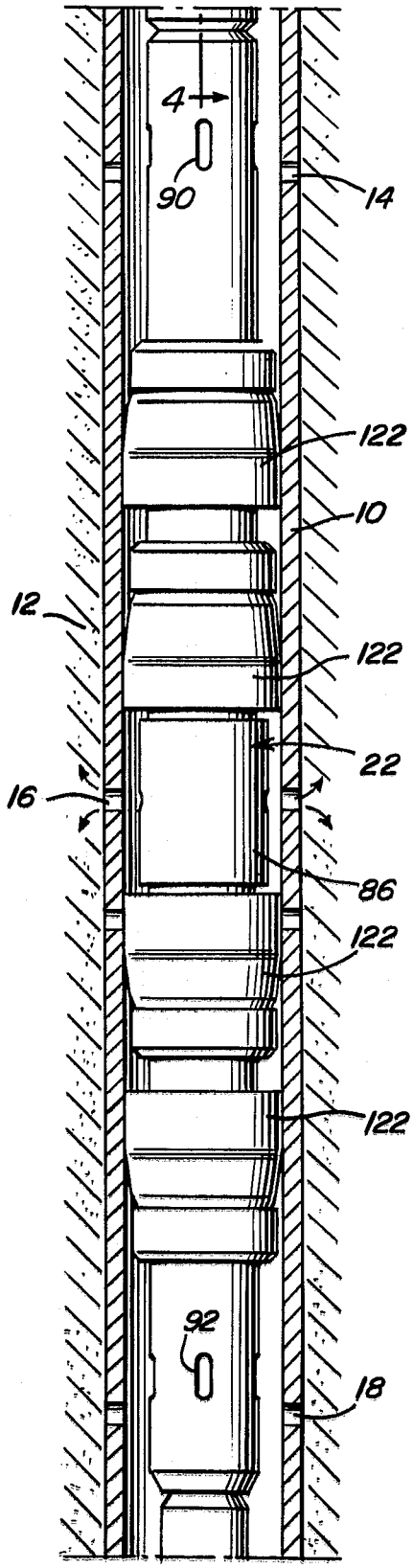
Figure 1B:
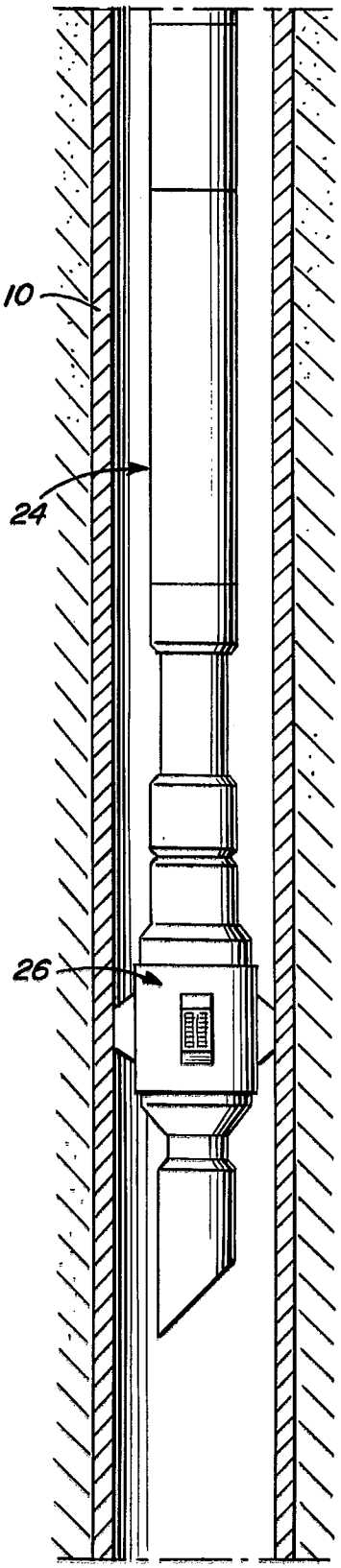
Figure 2:
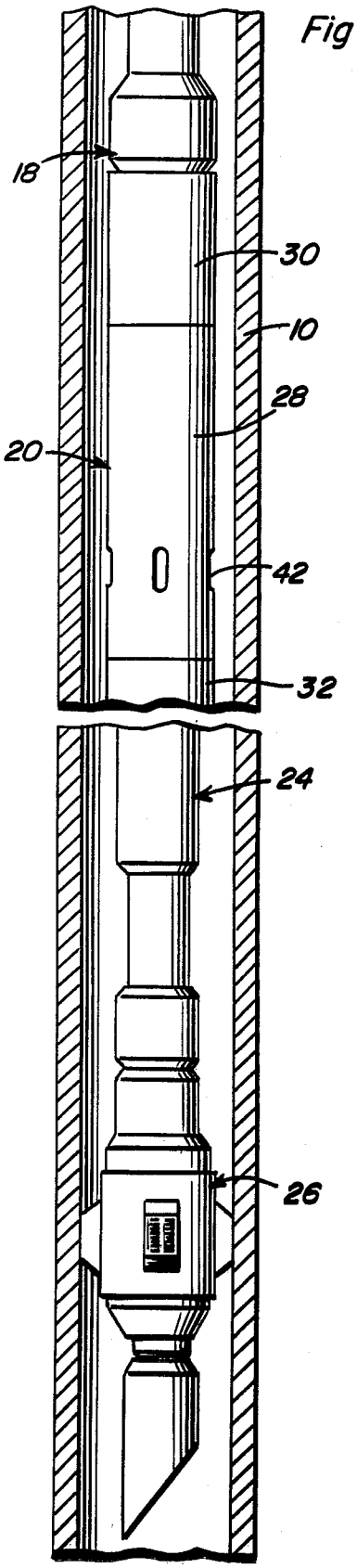
FIG. 2 is a vertical sectional view of the well casing with the apparatus of the instant invention having its central portion broken away and the lower tubing tester portion thereof in a closed position and the upper safety bypass portion thereof in an open position.
Figure 3:
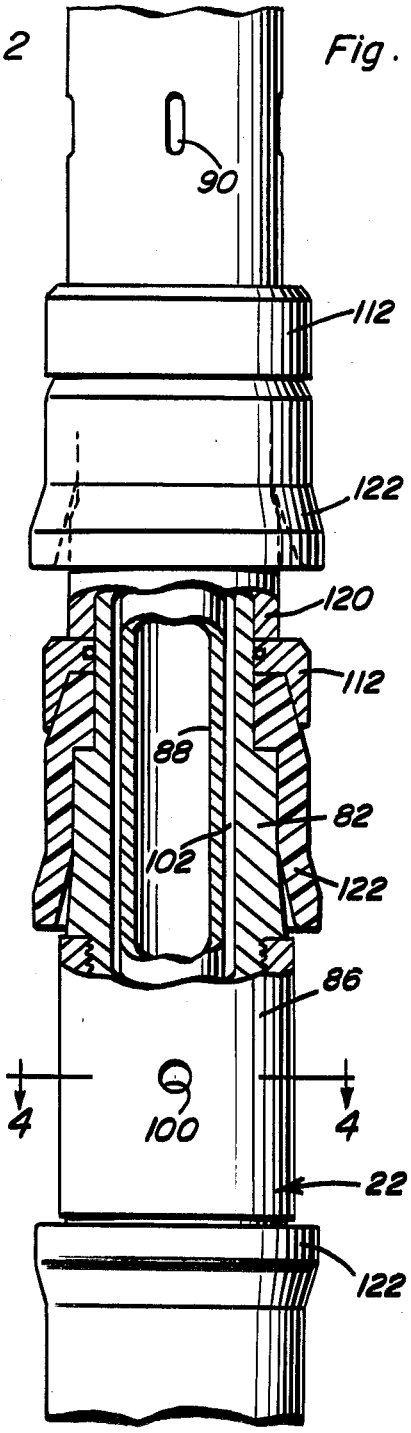
FIG. 3 is an enlarged fragmentary elevational view of the central perforation wash tool portion of the invention with portions of the perforation wash tool being broken away and illustrated in vertical sections.
Figure 4:
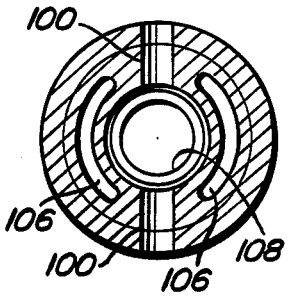
FIG. 4 is a horizontal sectional view taken substantially upon the plane indicated by the section line 4—4 of FIG. 3.
Figure 6:
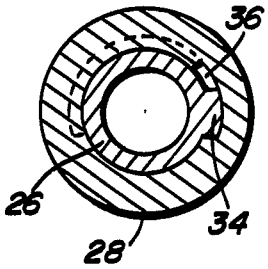
Figure 7A:
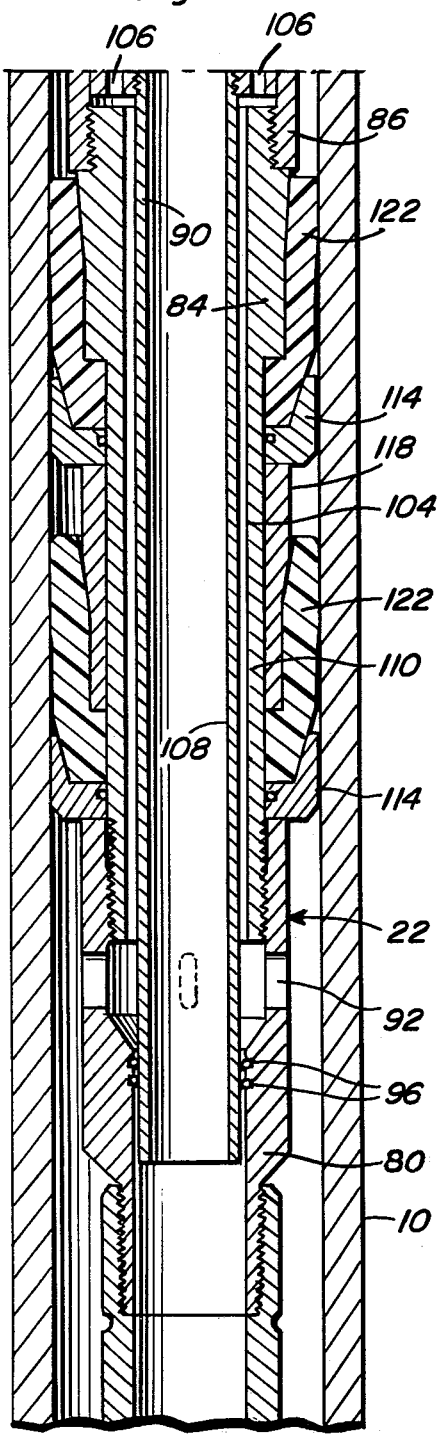
Figure 8:
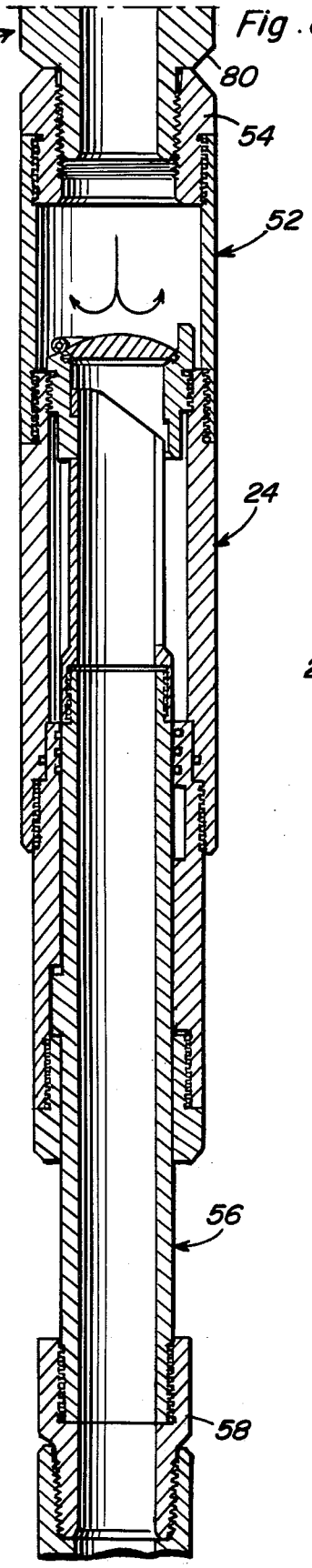
Figure 8A:
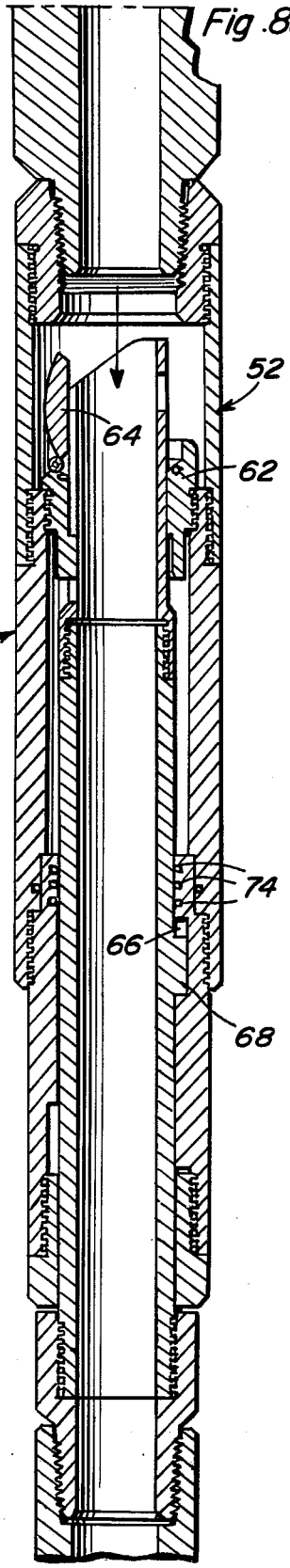

FIG. 5*a* is a vertical sectional view similar to FIG. 5 but with the safety bypass in the open position;

FIG. 6 is a horizontal sectional view taken substantially upon the plane indicated by the section line 6—6 of FIG. 5;

FIG. 7 is a fragmentary enlarged vertical sectional view of the upper portion of the perforation wash tool;

FIG. 7*a* is an enlarged fragmentary vertical sectional view of the lower portion of the perforation wash tool;

FIG. 8 is a vertical sectional view of the tubing tester portion of the invention in a fully closed position;

FIG. 8*a* is a vertical sectional view similar to FIG. 8 but with the tubing tester portion of the invention in a fully open position;

FIG. 9 is a fragmentary vertical sectional view of the upper portion of the tubing tester portion of the invention illustrating the flap valve thereof in the fully closed position;

FIG. 10 is a schematic view of one pair of coacting interlocking lugs and recesses on the tubing tester; and FIG. 11 is a schematic view of one pair of coacting interlocking lugs and recesses on the safety bypass portion of the instant invention.

DETAILED DESCRIPTION OF THE INVENTION

Referring now more specifically to the drawings, the numeral 10 generally designates a well casing projecting downwardly through a production zone 12. The casing 10 is perforated at vertically spaced zones therealong as at 14, 16 and 18.

For various reasons it may become necessary to wash the perforations 16 or to acidize or plasticize, et cetera. In addition, it is also sometimes necessary to re-perforate.

At present various forms of tools are provided for performing these different operations. While some tools are capable of performing more than one operation, there is no existing tool which is operative to perform all of these operations, all in one trip into the casing 10.

The tool assembly of the instant invention is referred to in general by the reference numeral 18 and includes an upper safety bypass assembly referred to in general by the reference numeral 20, an intermediate wash tool referred to in general by the reference numeral 22 and a lower tubing tester of the full openable and full closing type referred to in general by the reference numeral 24. In addition, a drag block referred to in general by the reference numeral 26 and of conventional design is disposed on the string below the tubing tester 24.

Referring now more specifically to the drawings and to FIGS. 5 and 5*a* wherein the safety bypass 20 may be seen in the closed and open positions, respectively, the safety bypass 20 comprises inner and outer tube sections 26 and 28 telescopingly engaged with each other at one pair of adjacent ends. The other pair of adjacent ends of the sections 26 and 28 may be considered to define upper and lower subs 30 and 32 for conventional threaded engagement with adjacent sections of the tool assembly 18 and the tubing string disposed thereabove.

The tubing section 26 includes an outstanding lug 34 thereon and the tubing section 28 includes a recess 36 formed in its inner surfaces and the shape of the recess 36 may best be seen in FIG. 10. Further, the section 26 includes a plurality of radial slots 40 formed therein and the section 28 includes similar slots 42 formed in a diametrically enlarged inner portion 42 thereof. The section 28 includes three vertically spaced pairs of O-ring seals 46, 48 and 50 for forming a fluid-tight seal between the inner surfaces of the section 28 and the outer surfaces of the section 26.

From a comparison of FIGS. 5 and 5*a* wherein the safety bypass 20 is in the closed and open positions, respectively, it may be seen that the slots 40 are disposed above the seals 48 in FIG. 5 and are thus maintained out of communication with the slots 42. However, the slots 40 are disposed below the O-ring seals 48 in FIG. 5*a* and are thus in communication with the slots 42.

With attention now invited more specifically to FIGS. 8 and 8*a* of the drawings, it may be seen that the tubing tester 24 is illustrated in a closed position in FIG. 8 and in an open position in FIG. 8*a*.

The tubing tester 24 includes an upper outer tubular assembly referred to in general by the reference numeral 52 including an upper sub 54 at its upper end for threaded engagement with the lower end of the wash tool 22. In addition, the tubing tester 24 includes a lower inner tubular assembly referred to in general by the reference numeral 56 having a lower sub 58 on its lower end for threaded engagement with the lower terminal end or drag block 60 of the tool assembly 18.

The upper outer tubular assembly includes an inner valve seat 62 supported therefrom with which a spring biased pivoted valve member 64 is operatively associated and the upper outer tubular assembly 52 further includes an inner recess 66 similar to but differently shaped from the recess 36, see FIG. 11. The inner tubular assembly 56 includes a radially outstanding lug 68 corresponding to the lug 34 and which is operable in the recess 66. Of course, it is to be noted that the upper end of the inner tubular assembly 56 is slidingly telescoped upwardly into the lower end of the outer tubular assembly 52 and from FIG. 8*a* of the drawings it may seen that the upper terminal end of the inner tubular assembly 56 is projectable upwardly through the valve seat 62 for engagement with the swingable valve member 64 in order to swing the latter toward its open position and to maintain the valve member in its open position against closing. The valve member 64 includes a valve face 70 engageable with a ring 72 carried by the valve seat 62. Accordingly, the valve member 64 may form a substantially fluid-tight seal with the valve seat 62.

From FIG. 10 of the drawings it may be seen that the recess 36 includes a substantially vertical portion 36' and oppositely horizontally directed upper and lower portions 36'' and 36'''. Further, it may be seen from FIG. 11 of the drawings that the recess 66 includes a vertical portion 66' and similarly horizontally directed upper and lower portions 66'' and 66'''.

It is also pointed out that the tubing tester 24 includes O-ring seals 74 carried by the upper outer tubular assembly 52 and forming a fluid-tight seal with the lower inner tubular assembly 56 which is both rotatable and slidable relative to the upper outer tubular assembly 52.

With reference now more specifically to FIGS. 7 and 7*a* of the drawings, it may be seen that the wash tool 22 includes top and bottom subs 78 and 80 threaded onto and into the lower sub 32 of the safety bypass 70 and the upper sub 54 of the tubing tester 24. The subs 78 and 80 are threaded onto the upper and lower ends, respectively, of upper and lower outer mandrils 82 and 84 and the lower and upper ends of the mandrils 82 and 84 are threaded into the center body 86. The top and bottom subs 78 and 80 include O-ring seals 94 and 96 sealingly engaged with the upper and lower ends of the inner mandrils 88 and 90 above and below the slots 90 and 92 and the center body 86 includes diametrically opposite radial bores 100 which communicate the interior of the center body 86 with the exterior thereof. It may also be seen that the outer and inner mandrils 82, 88 and 84, 90 are spaced relative to each other and define annular passages 102 and 104 therebetween. The adjacent ends of the passages 102 and 104 are communicated with each other by means of longitudinal passages 106 formed through the center body 86. Accordingly, the passages 102 and 104 and the slots 90 and 92 define a bypass passage outwardly of the center passage 108 defined through the inner mandrils 88 and 90 and the center body 86. The bypass passage 110 is provided for purpose to be hereinafter more fully set forth.

The wash tool 22 includes upper and lower pairs of packer cup thimbles 112 and 114 having packer cup spacers 118 and 120 spaced therebetween and each packer cup thimble supports a packer cup 122, the packer cups 122 being spaced intermediate the slots 90 and 92. Accordingly, the bypass passage 110 bypasses the packer cups 122.

The tool assembly comprising drag block 60, the safety bypass 20, the wash tool 22 and the tubing tester 24 is made up in the manner illustrated and the tubing string is lowered into the casing 10 with the safety bypass 20 and the tubing tester 24 in the closed position, the bypass passage 110 enabling the fluid within the casing 10 to bypass the packers 122 during lowering of the tool assembly 16 in the casing 10.

When the predetermined depth of the tool assembly 18 is achieved with the wash tool 22 registered with the perforations 16, the operator slacks down and torques the drill string to the right whereby the safety bypass will have the lug 34 thereof shifted to the left as viewed in FIG. 11 of the drawings to unlock the safety bypass 20. Then, the operator slacks down again whereby the lug 34 will move downwardly through the portion 36' of the recess 36 and the operator then torques to the left whereby the lug 34 will be shifted to the right as viewed in FIG. 11 of the drawings to be moved into the portion 36''' of the recess 36 in order to lock the safety bypass in the closed position. Each time the drill string is torqued to the right or to the left it is angularly displaced approximately ninety degrees. After the safety bypass has been locked in the closed position, the operator then torques another quarter turn to the left which swings the recess 66 to the right as viewed in FIG. 10 of the drawings and thus unlocks the tubing tester 24. Thereafter, the operator picks up on the string to which the tool assembly 18 is attached and thereafter further turns the string to the left one quarter turn whereby the lug 68 will be locked in the lower horizontal portion 66' of the recess 66.

When the tubing tester is shifted from the open position thereof illustrated in FIG. 8*a* of the drawings to the closed position thereof illustrated in FIG. 8, the upper outer tubular assembly 52 is elevated relative to the inner tubular assembly 56 and the pivoted valve member 64 is therefore free to pivot to the closed position thereof illustrated in FIGS. 8 and 9.

After the safety bypass and tubing tester have been closed with the perforation wash tool 22 registered with the desired perforations 16, pump pressure is applied internally through the wash string. With the safety bypass and the tubing tester closed, the fluid can exit only through the bores 100 in the center body 86 of the wash tool. As the fluid enters the annular space between the center body 86 and the internal surfaces of the casing 22, it moves in behind the packers 122 causing the latter to expand into tight sealed engagement with the inner surface of the casing 10. After the seal is complete, pump pressure can be increased to overcome the pressure of the producing zone of the formation 12 with which the perforations 16 are registered. Depending upon the particular problem, the producing sand can be acidized, plasticized or otherwise treated. In addition, inasmuch as the safety bypass and tubing tester are of the full opening type, the casing 10 may be re-perforated without withdrawing the tool assembly 18 from the casing 10.

The bypass passage 110 is provided to allow fluid to pass freely around or bypass the perforation wash tool 22 as it is lowered or raised. This is necessary becuase the outside diameter of the packers 122 and the inside diameter of the casing 10 are nearly identical thus causing a constriction at the point of the packers 122. If no bypass such as the bypass 110 was provided, the time it would take to run in and pull out the perforation wash tool 22 would probably prohibit its use.

In order to move the tool assembly or to pull out of the casing 10, the tubing tester 24 is opened and the safety bypass is opened and the tool string may be pulled. To open the tubing tester 24 and the safety bypass 20, the operator picks up on the string, torques to the right and sets down, just the opposite of closing. Then, he torques to the left to unlock the tubing tester and safety bypass.

If sand clogs up the perforation wash tool 22 and/or the tubing tester 24, by opening the safety bypass 20 all fluid inside the wash pipe will drain out into the annular space exteriorly of the wash space and interiorly of the casing 10 as the wash pipe is pulled. This prevents the operator from having to pull a "wet string."

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A perforation wash tool including an elongated tubular assembly defining a longitudinal main passage therethrough, longitudinally spaced opposing packer means carried by and extending about the exterior of said tubular assembly intermediate the opposite ends thereof, said tubular assembly including a continuously open bypass passage extending therealong independent of said main passage and opening, at its opposite ends, to the exterior of said assembly on the remote sides of said packer means, said assembly further including continuously open perforation wash fluid passage means communicating the interior of said central passage with the exterior of said assembly intermediate said packer means, said main passage extending the full length of said wash tool, being longitudinally straight and unobstructed and opening centrally outwardly of the opposite ends of said tubular assembly, said bypass being defined by a generally annular passage extending longitudinally of said tubular assembly disposed about said main passage inwardly of the exterior of said tubular assembly, said wash tool including a central tubular body having a threaded bore formed therethrough including opposite end threaded counterbores, loosely telescopingly engaged inner and outer tubular mandrils threaded into said bores and counterbores, respectively, at each end of said body, tubular end subs threaded onto the remote ends of said outer mandrils and into which the remote ends of said inner mandrils are rotatably and telescopingly sealingly received, said packer means being carried by said outer mandrils, said central body including a flow passage therethrough, outwardly of said threaded bore, communicating the annular areas defined between said inner and outer mandrils, said subs including lateral openings therein opening into said annular areas, said flow passage, annular areas and lateral openings defining said bypass passage, and said wash fluid passage means including lateral ports in said central body opening into said threaded bore and outwardly of the exterior of said central body independent of said flow passage.

2. A perforation wash tool including an elongated tubular assembly defining a longitudinal main passage therethrough, longitudinally spaced opposing packer means carried by and extending about the exterior of said tubular assembly intermediate the opposite ends thereof, said tubular assembly including a continuously open bypass passage extending therealong independent of said main passage and opening, at its opposite ends, to the exterior of said assembly on the remote sides of said packer means, said assembly further including continuously open perforation wash fluid passage means communicating the interior of said central passage with the exterior of said assembly intermediate said packer means, said wash tool including a central tubular body having a threaded bore formed therethrough including opposite end threaded counter-bores, loosely telescopingly engaged inner and outer tubular mandrils threaded into said bores and counterbores, respectively, at each end of said body, tubular end subs threaded onto the remote ends of said outer mandrils and into which the remote ends of said inner mandrils are rotatably and telescopingly sealingly received, said packer means being carried by said outer mandrils, said central body including a flow passage therethrough, outwardly of said threaded bore, communicating the annular areas defined between said inner and outer mandrils, said subs including lateral openings therein opening into said annular areas, said flow passage, annular areas and lateral openings defining said bypass passage, and said wash fluid passage means including lateral ports in said central body opening into said threaded bore and outwardly of the exterior of said central body independent of said flow passage, a well tubing string in which said wash tool is serially connected, said string including selectively openable closure means operative to block the downward movement of fluid through said string at a point below said wash tool.

3. The combination of claim 2 wherein said closure means includes a selectively openable and closable member, said closure means defining a full open passage therethrough along the center line of said main passage when said closure means is open, said full open passage extending, unobstructed, longitudinally and centrally through said tubing string.

4. The combination of claim 3 wherein said string also includes selectively openable and closable bypass means above said wash tool operative to selectively bypass fluid between said full open passage and the exterior of the string.

5. The combination of claim 4 wherein string includes a drag block on its lower end below said closure means, said closure means and bypass means including control means operative in conjunction with the engagement of said drag block on the exterior of an associated casing, to successively open and successively close said closure and bypass means in response to combinations of longitudinal and angular shifting of the supported end of said string in said casing.

6. The combination of claim 3 wherein said closure means includes upper and lower subs for attachment to tubing string sections above and below said closure structure, said upper and lower subs including external and internal telescopingly engaged lower and upper end tube sections including coacting stop means limiting relative lengthwise shifting of said tube sections thereof between extended and retracted positions thereof, seal means establishing a fluid seal between lower portions of said tube sections, said external tube section including an upwardly facing internal valve seat through which the upper end of said internal tube section is upwardly projectable and downwardly retractable upon movement of said tube sections to said retracted and extended positions thereof, a valve member pivotally supported from said external tube member and swingable into and out of downwardly facing closed position closing said seat from above, said internal tube section, when said internal and external tube sections are shifted from said extended positions to said retracted positions being projectable upwardly through said seat from below to engage and swing said valve member from the closed position to the open position thereof.

7. The combination of claim 3 where said string also includes selectively openable and closable bypass means above said wash tool operative to selectively bypass fluid between the interior and exterior of the string, said bypass means including upper and lower subs for attachment to string sections above and below said bypass structure, said upper and lower subs including internal and external telescopingly engaged lower and upper end tube sections including coacting stop means limiting relative lengthwise shifting of said tube sections between extended and retracted positions thereof, said external tube section including a diametrically enlarged interior portion intermediate the opposite ends of said external tube section and interior seal means above and below said diametrically enlarged interior portion sealingly engaged with the exterior surfaces of said interior tube section, said external tube section including lateral openings therein opening into said diametrically enlarged interior portion, said internal tube section including lateral openings therein shiftable past one of said seal means into and out of registry with said diametrically enlarged interior portion upon relative shifting of said tube sections between said extended and retracted positions thereof.

8. A selectively openable and closable bypass structure for the lower end portion of a tubing string to be run in a well, said bypass structure including upper and lower subs for attachment to string sections above and below said bypass structure, said upper and lower subs including internal and external telescopingly engaged lower and upper end tube sections including coacting stop means limiting relative lengthwise shifting of said tube sections between extended and retracted positions thereof, said external tube section including a diametrically enlarged interior portion intermediate the opposite ends of said external tube section and interior seal means above and below said diametrically enlarged interior portion sealingly engaged with the exterior surfaces of said interior tube section, said external tube section including lateral openings therein opening into said diametrically enlarged interior portion, said internal tube section including lateral openings therein shiftable past one of said seal means into and out of registry with said diametrically enlarged interior portion upon relative shifting of said tube sections between said extended and retracted positions thereof.

9. The combination of claim 8 wherein said internal and external tube sections are telescopingly engaged for limited relative angular displacement and include coacting structure for selectively locking said tube sections in said extended and retracted positions in response to relative angular displacement thereof.

10. A selectively openable and closable structure for the lower end portion of a tubing string, said closure structure including upper and lower subs for attachment to tubing string sections above and below said closure structure, said upper and lower subs including external and internal telescopingly engaged lower and upper end tube sections including coacting stop means limiting relative lengthwise shifting of said tube sections thereof between extended and retracted positions thereof, seal means extablishing a fluid seal between lower portions of said tube sections, said external tube section including an upwardly facing internal valve seat through which the upper end of said internal tube section is upwardly projectable and downwardly retractable upon movement of said tube sections to said retracted and extended positions thereof, a valve member pivotally supported from said external tube member and swingable into and out of downwardly facing closed position closing said seat from above, said internal tube section, when said internal and external tube sections are shifted from said extended positions to said retracted positions, being projectable upwardly through said seat from below to engage and swing said valve member from the closed position to the open position thereof.

11. The combination of claim 10 wherein said internal and external tube sections are telescopingly engaged for limited relative angular displacement and include coacting structure for selectively locking said tube sections in said extended and retracted positions in response to relative angular displacement thereof.

* * * * *